United States Patent [19]

Kuykendall

[11] Patent Number: 4,762,041

[45] Date of Patent: Aug. 9, 1988

[54] DISPENSING MECHANISM FOR SEPARATING COUPONS FROM A CONNECTED RIBBON OF COUPONS

[75] Inventor: Harold D. Kuykendall, Peoria, Ill.

[73] Assignee: General Methods Corporation, Peoria, Ill.

[21] Appl. No.: 17,529

[22] Filed: Feb. 24, 1987

[51] Int. Cl.[4] ..... B26D 5/20

[52] U.S. Cl. ..... 83/278; 83/369; 83/371; 83/695; 226/68

[58] Field of Search ..... 83/278, 369, 370, 371, 83/695; 226/68, 71; 198/859

[56] References Cited

U.S. PATENT DOCUMENTS

| | | | |
|---|---|---|---|
| 2,049,135 | 7/1936 | Peyser | 83/17 |
| 2,725,101 | 11/1955 | Von Hofe | 83/251 |
| 3,013,368 | 12/1961 | Macomber . | |
| 3,013,740 | 12/1961 | Macomber . | |
| 3,174,371 | 3/1965 | Macomber | 83/86 |
| 3,255,649 | 6/1966 | Buttery | 83/695 |
| 3,293,964 | 12/1966 | Macomber . | |
| 3,435,717 | 4/1969 | Macomber | 83/176 |
| 3,578,229 | 5/1971 | Macomber | 226/114 |
| 3,823,633 | 7/1974 | Ross | 83/346 |
| 3,992,967 | 11/1976 | Fram | 83/347 |
| 4,077,289 | 3/1978 | Rudszinat | 83/152 |
| 4,405,070 | 9/1983 | Blaschek | 226/68 |

FOREIGN PATENT DOCUMENTS 1578180 11/1980 United Kingdom .

*Primary Examiner*—E. R. Kazenske
*Assistant Examiner*—Eugenia A. Jones
*Attorney, Agent, or Firm*—Allegretti & Witcoff

[57] ABSTRACT

A mechanism for feeding a ribbon having discrete three dimensional objects includes a specially formed finger which fits through a U-shaped opening from the back side of the ribbon and incrementally drives the ribbon into position where it is severed along a predetermined line by a knife which moves transverse to the direction of movement of the ribbon. The knife includes a gap in the blade opposite the U-shaped opening to avoid severing a tab associated with the U-shaped opening.

7 Claims, 9 Drawing Sheets

FLOW
10
12
14
16
18
20
21
22
24
26
28
30
32
33
34
38
40

18
1ST. POS.
52
56
50
54
3rd POS.
59
38
24
24
44
81
82
80
110

DISPENSING MECHANISM FOR SEPARATING COUPONS FROM A CONNECTED RIBBON OF COUPONS

BACKGROUND OF THE INVENTION

This invention relates to a mechanism especially useful for separating a web of discrete connected elements, each element having a three dimensional object attached to the individual element.

Placement of a three dimensional premium in a box or package during a packaging operation is commonly done for many consumer products. For example, a single premium such as a small toy is often placed in a cereal box. Typically the premium Is retained on a paper or cardboard backing.

Dispensing of such a premium into a container may be effected in various ways. For example, a plurality of such premiums may be incorporated in a ribbon or web of connected elements, each element having a single premium thereon. The web may be fed from a roll by means of a feeding mechanism and single elements or units are then cut from the web or ribbon and delivered into an individual package one at a time.

Various mechanisms have been developed over the years for feeding and cutting of two dimensional coupons, rather than three dimensional premiums, from a web for subsequent feeding into a package. For example, Peyser in U.S. Pat. No. 2,049,135 discloses a method and mechanism for feeding a web of flexible material and severing discrete elements or coupons from the web. As the web is fed into the mechanism, a precut tab in the web engages against a stop on a knife. The stop on the knife holds the web in fixed position and the knife then translates to cut the web at a precise place determined by the position of the precut tab. The Peyser patent does not disclose placement of a three dimensional premium on the individual coupons.

Macomber in U.S. Pat. No. 3,013,368 discloses yet another mechanism for removing single units or coupons from a ribbon or web. In the Macomber '368 patent, each of the units serves as a cigar band. Macomber teaches in U.S. Pat. No. 3,174,371 another mechanism for feeding a ribbon of severable units used for cigar bands. Macomber discloses a foot, shown in FIG. 18, to engage a U-shaped slot, as shown in FIG. 17, and move the ribbon.

Van Hofe in U.S. Pat. No. 2,725,101 discloses a ribbon feeding mechanism wherein a slit between coupons defining the ribbon is engaged and deformed by a foot or shoe in order to move the coupon. The coupon fits between a pair of rollers and is driven in response to reciprocal motion of the foot.

Macomber in U.S. Pat. No. 3,293,964 shows a band ribbon feeding mechanism substantially like that shown in U.S. Pat. No. 3,174,371.

Macomber in U.S. Pat. No. 3,435,717 discloses a label feed and cutting means which cooperatas with a slot or slit extending as a straight line between edges of the ribbon and which is engaged by a reciprocating foot. A separate knife severs the ribbon as it is moved along a conveyor in incremental amounts by the described foot.

Macomber in U.S. Pat. No. 3,578,229 discloses a mechanism for feeding a web or ribbon from a reel.

Ross in U.S. Pat. No. 3,823,633 discloses a cutting roller which is used to cut slots in ribbons of coupons so that the coupons can be driven by a foot or other drive mechanism of the type disclosed in the Macomber patents and other patents.

Fram in U.S. Pat. No. 3,992,967 discloses yet another cutting device of the general type depicted in the Ross '633 patent.

Rudszinat in U.S. Pat. No. 4,077,289 discloses a ribbon feeding mechanism wherein a foot reciprocates along an arcuate path to drive the ribbon forward in incremental steps. A knife severs the ribbon at the end of each incremental step.

British Pat. No. 1,578,180 discloses yet another ribbon feeding mechanism wherein precut slots separating the units of the ribbon are severed at the opposite ends to thus separate portions of the ribbon. The ribbon again is a flat ribbon without any three dimensional objects attached to either side.

Despite the abundance of prior art, there has remained the need for providing a ribbon or web feeding mechanism which will feed units of coupons from a continuous roll particularly where each of the separate units have a three dimensional object or premium attached thereto.

For example, a piece of candy or a toy may be attached to each separate coupon or unit segment of the ribbon or web. The candy is a three dimensional object which projects from the surface of the ribbon. It is desired then to cut or separate the ribbon along the line intermediate each unit of candy. The cut should be uniform, easily and quickly made, and should not inhibit the continued feeding of premium units at high speed. These objectives, among others, inspired the development of the present invention.

SUMMARY OF THE INVENTION

In a principal aspect, the present invention comprises an improved mechanism for feeding a web, a strip or a ribbon of material comprised of connected coupons or units with three dimensional objects or premiums uniformly positioned and spaced on the web. The device further provides a mechanism for cutting the ribbon in discrete lengths to thereby separate each unit with a premium from the other and then feeding the discrete units, including the three dimensional object thereon, into a box or some other receptacle. Thus, the ribbon is divided into discrete units or sections each separated from the other by an imaginary line. Intersecting each imaginary line is a tab which is cut through the material forming the ribbon. The tab has a free end directed toward the direction of ribbon travel in the mechanism.

The ribbon passes over an arcuate run or pathway thereby causing the tab to project tangentially from the arcuate path and the plane of the ribbon or web. The sides of the ribbon are retained within the pathway. The three dimensional object or premium is maintained on the outer surface of the ribbon and extends from the ribbon in the direction of a radius extending from the center of curvature of the arcuate pathway. The back side or inside of the ribbon slides smoothly over the arcuate pathway.

The ribbon then enters a straight portion of the pathway where it is engaged by a finger having a plow or nose which fits through the tab opening. The finger moves between a position where the plow engages through the tab opening to a position where the plow is released from the tab opening. The finger is mounted on a carriage supported by the frame for the mechanism. The carriage reciprocates, moving first in the direction of ribbon travel to transport the ribbon which is engaged by the plow through the tab opening. Upon travel to the maximum extent in the ribbon travel direction, the finger disengages from the ribbon and the carriage moves a unitary distance in the opposite direction. In this manner the ribbon is incrementally moved one unit at a time to thereby position the end of the ribbon in opposed relationship with a knife that is arranged transverse to the path of the ribbon. When the ribbon is so positioned, the knife moves to engage and cut the ribbon along the imaginary line separating the units. The knife has a special construction wherein a gap is provided in the blade positioned opposite the tab so that the tab is not cut as the unit is separated or cut from the ribbon. The severed unit then falls vertically through a hopper or into a package.

Thus, it is an object of the invention to provide an improved feed mechanism for a ribbon particularly a ribbon having three dimensional objects attached thereto.

Yet a further object of the present invention is to provide a feed mechanism for a ribbon which feeds the ribbon incrementally by uniform and discrete amounts without interference with a three dimensional object attached to the surface of the ribbon.

A further object of the invention is to provide an improved ribbon feeding mechanism which is highly efficient, easy to use, and durable.

Yet another object of the invention is to provide a mechanism which is designed to easily sever separate units from a ribbon of material as those units are fed through the mechanism.

These and other objects, advantages and features of the invention will be set forth in the detailed description which follows.

BRIEF DESCRIPTION OF THE DRAWING

In the detailed description which follows, reference will be made to the drawing comprised of the following figures.

DESCRIPTION OF THE PREFERRED EMBODIMENT

General Description

Figures 1, 2:
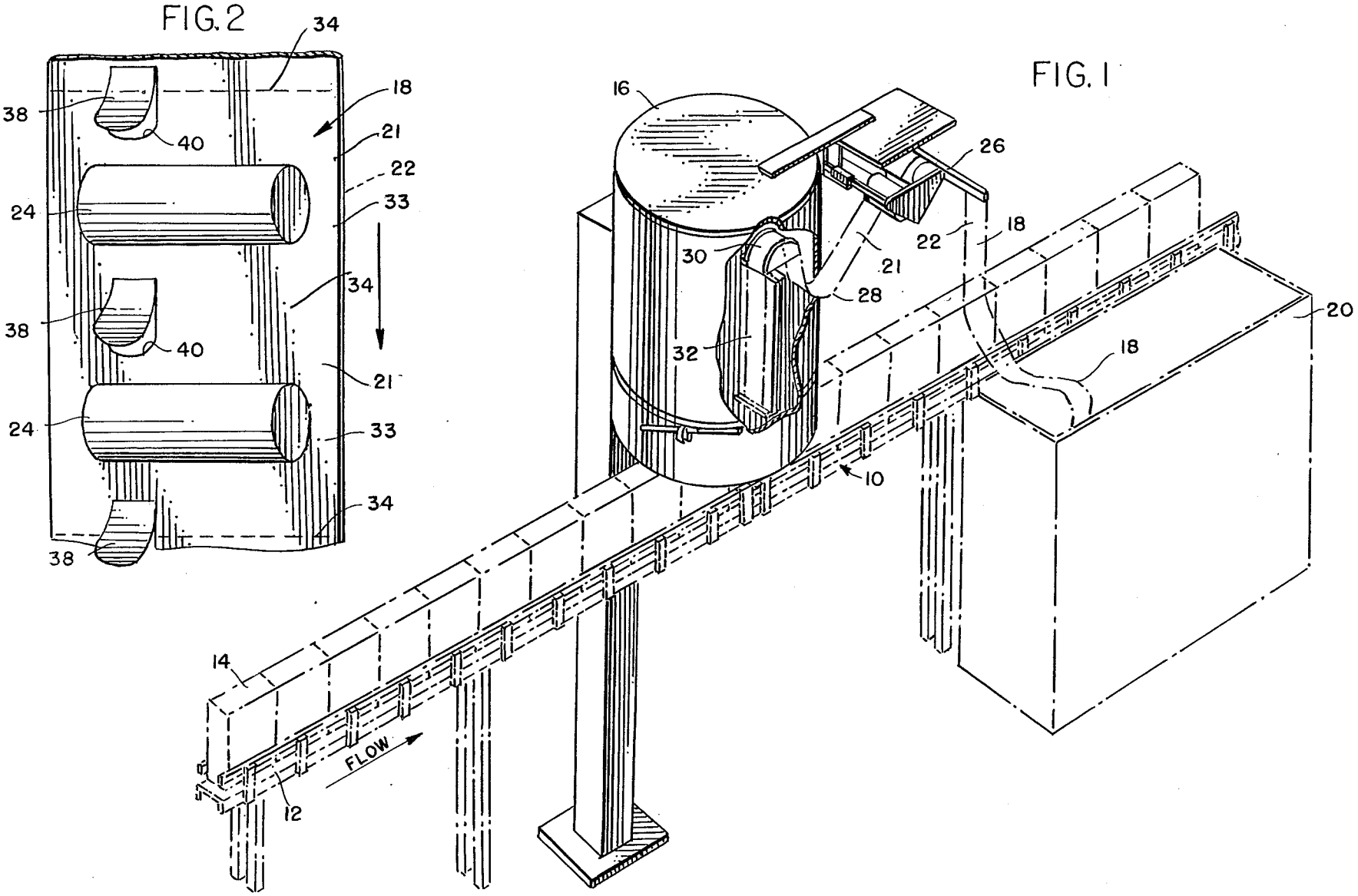
FIG. 1 is a schematic perspective view of the improved web or ribbon feed and cutting mechanism of the invention as incorporated with a typical packaging line.
FIG. 2 is an enlarged perspective view of the construction of a typical ribbon of premiums utilized in combination with the mechanism of the present invention.

FIG. 1 depicts the general overall environment in which the improved mechanism of the present invention will typically be utilized. Thus, for example, a packaging line 10 includes a conveyor 12 which transports a series of packages, for example filled cereal boxes 14, in the direction of line flow as depicted by the arrow in FIG. 1. The dispensing mechanism 16 of the present invention is positioned over the packages 14 on conveyor 12 and dispenses a single unit of a premium object 24 into each package 14 as the packages 14 intermittently move into position beneath mechanism 16.

As shown in FIGS. 1 and 2, each premium object 24 which is dispensed into the packages 14 is originally incorporated on a web or ribbon 18 retained in a storage carton 20. The ribbon 18 defines a front surface 21 and a back surface 22. positioned on the front surface 21 and mounted on single separate premium units or elements 33 are three dimensional premium objects 24. The ribbon 18 will, for example, be comprised of a sheet of paper with a sheet of plastic or other material overlaying and adhering to the front surface 21 to thereby retain the premium objects 24.

The ribbon 18 is thus fed from the carton 20 through a preconveyor assembly 26. The preconveyor assembly 26 includes a drive mechanism to maintain the ribbon 18 in the form of a generally loose feed loop 28 as ribbon 18 is fed into the dispensing mechanism 16.

Within the mechanism 16, the ribbon 18 moves along an arcuate pathway or run 30 and then into a straight line pathway or run 32. Individual units or premium elements 33 are cut from the ribbon 18 as it is moved incrementally downward along pathway 32 in appropriate timed relationship with the movement of the packages or boxes 14. The individual premium elements 33 thus are severed from the ribbon 18 and discharged into the packages 14 as the web 18 moves incrementally along the pathway 32 and in time relation with the packages 14 moving on the conveyor 12. The particular construction of the mechanism for transporting and severing the ribbon 18 into premium units 33 is depicted in greater detail in the following figures and constitutes the principal aspect of the present invention.

Referring again to FIG. 2, the ribbon 18 has a plurality of imaginary lines 34 separating the separate units 33 to define the individual or incremental units 33. Each imaginary line 34 is transverse to the sides of the ribbon 18 and extends in a straight line across the ribbon 18. The line 34 defines the line of separation or line along which a knife will ultimately separate the separate units 33.

Intermediate the opposite ends of the line 34 is a U-shaped tab 38 which is precut into the ribbon 18. The tab 38 extends across the imaginary line 34 and projects in the direction of ribbon 18 travel as indicated by the arrow in FIG. 2. The tab 38 thus defines a U-shaped opening 40 against which a finger or plow will impinge in a manner to be described below to transport the ribbon 18 in incremental amounts.

Referring to FIGS. 3–14, the ribbon 18 enters the mechanism 16 and is guided along the arcuate pathway 30 attached to the frame 44 of the mechanism 16. Thus, an arcuate support member or sheet 46 supports the back side 22 of the ribbon 18 with the product or premiums 24 disposed outwardly relative to the center 45 for the radius of curvature of the arcuate sheet 46. The arcuate sheet 46 guides ribbon 18 into the vertical pathway 32 and may assist the tabs 38 of ribbon 18 to bend outwardly tangential to support sheet 46 as depicted in the figures to thereby define the opening 40 for cooperation with a drive finger as will be described below.

The arcuate sheet 46 connects with the vertically extending downward pathway 32. positioned adjacent the pathway 32 are a pair of vertical rods 50 and 52 which slidably support a carriage 54. The carriage 54 is mounted for reciprocal, vertical movement on the rods 50 and 52 and is driven by an eccentric drive shaft 56 actuated by a rotary wheel 58. The shaft 56 is attached to the carriage 54 through a pivotal connection 59. As the shaft 56 moves in response to rotation of the wheel 58, the carriage 54 is reciprocated vertically on the rods 50 and 52.

Figure 3:
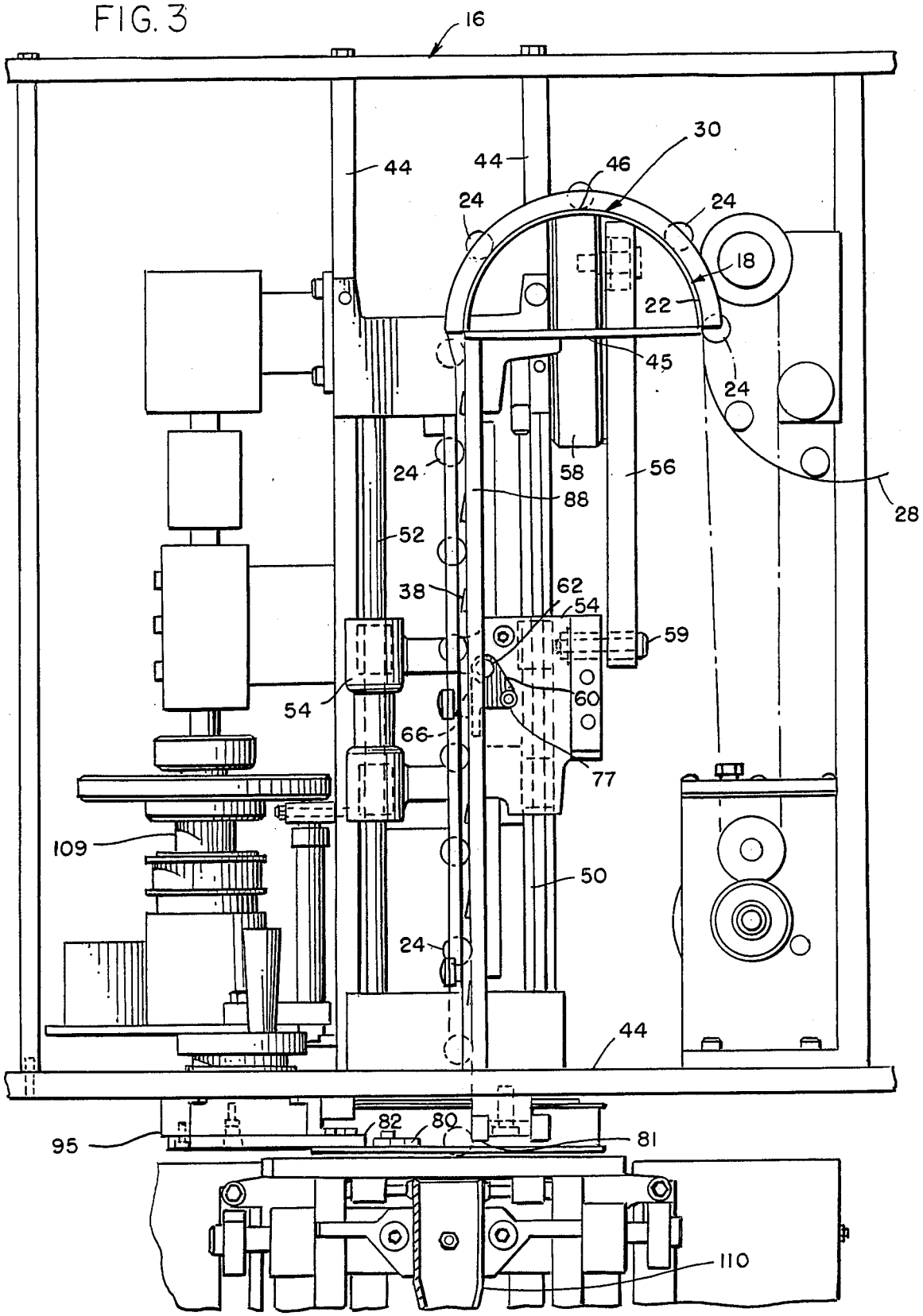
FIG. 3 is a side elevation of the improved mechanism of the present invention wherein the ribbon feed finger and the attached carriage for carrying the feed finger are positioned at their upper limit of travel.
Figure 4:
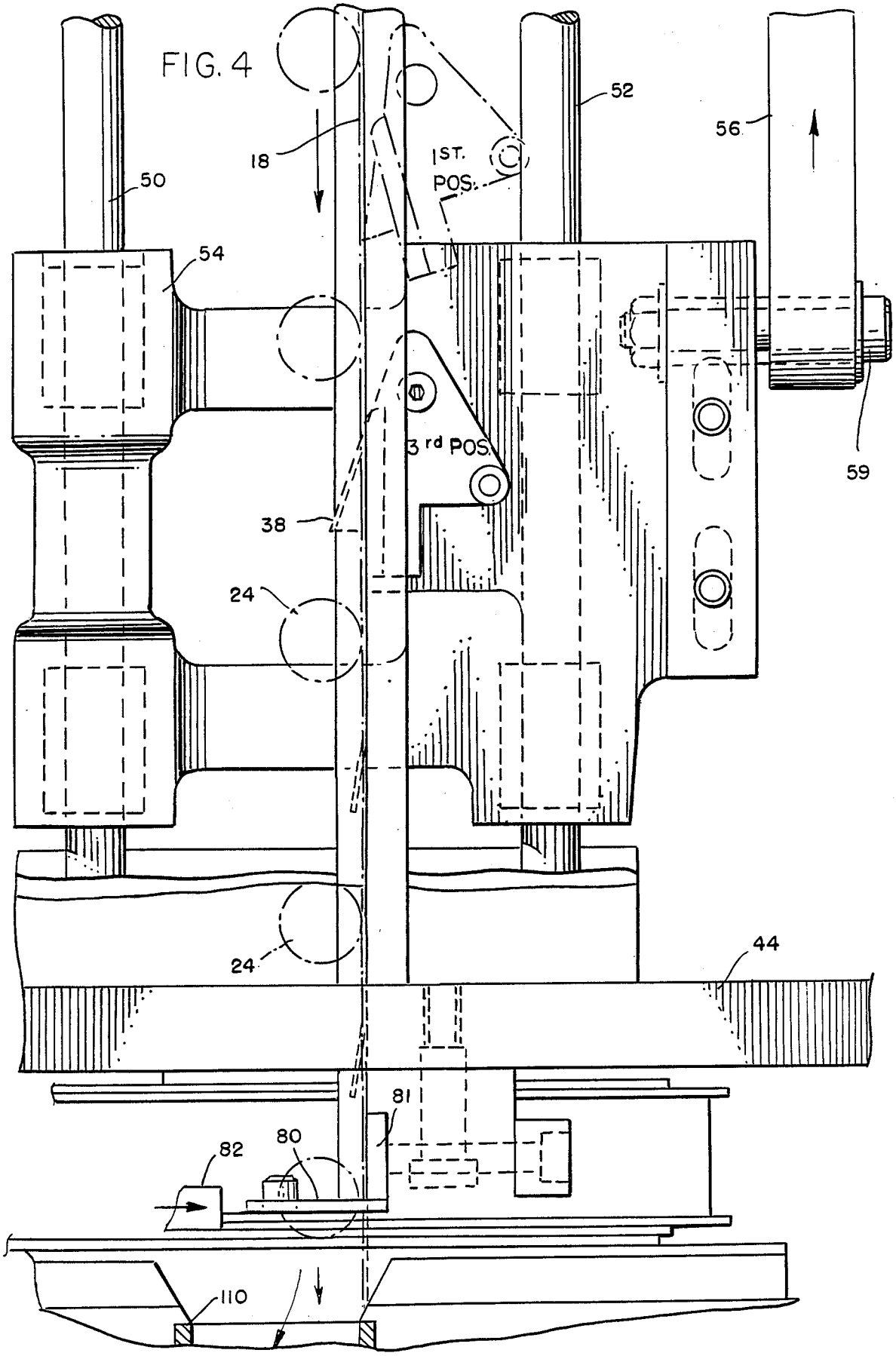
FIG. 4 is a side elevation similar to FIG. 3 wherein the feed finger has engaged the ribbon and has traveled partially forward to move and convey the ribbon along its pathway.
Figure 5:
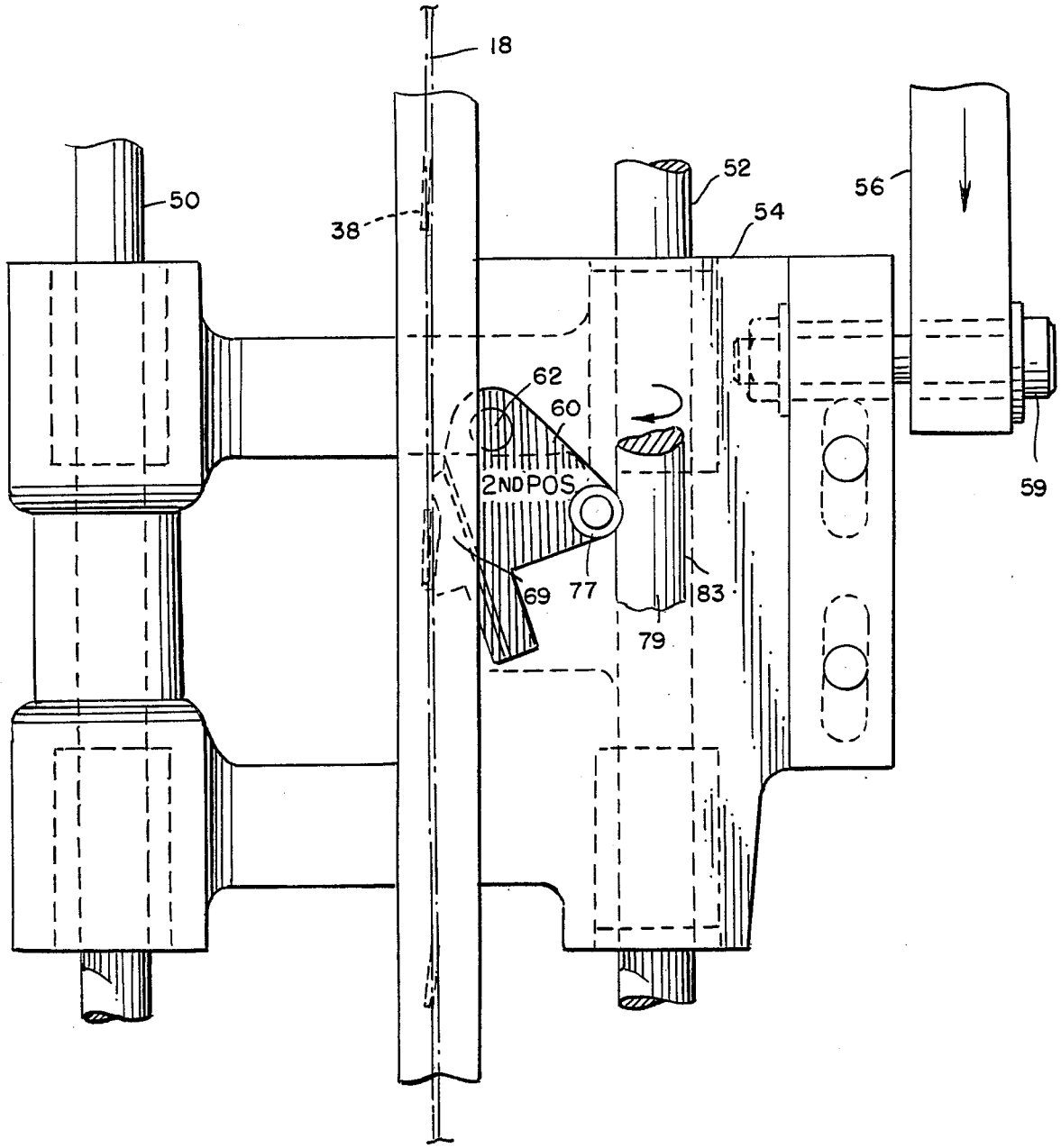
FIG. 5 is a side elevation similar to FIG. 4 wherein the ribbon is transported to its maximum extent by the engaging finger and associated carriage and further depicting severing of the ribbon by a knife.
Figure 6:
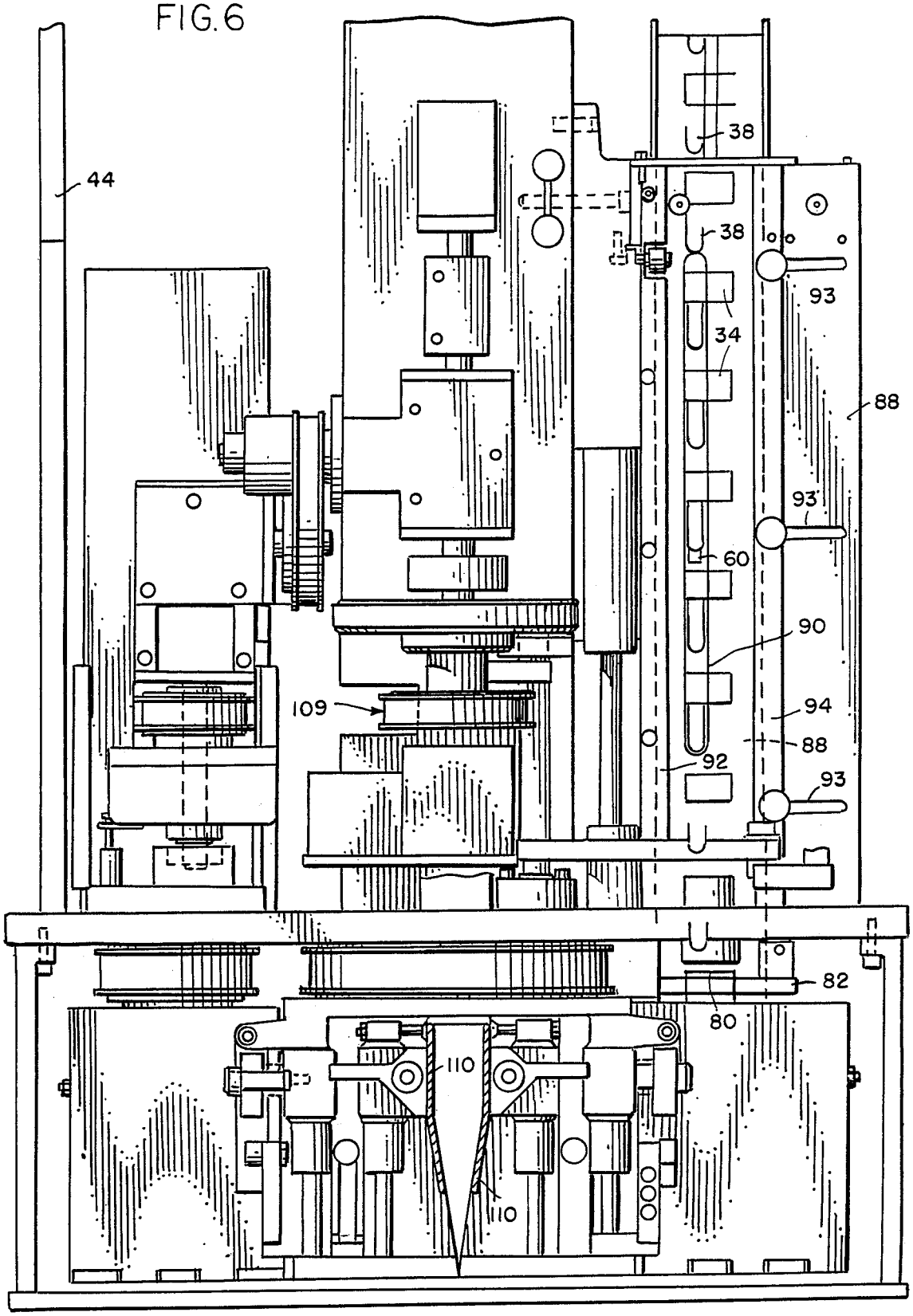
FIG. 6 is a front cross sectional view of FIG. 3 taken substantially along the line 6—6.
Figure 7:
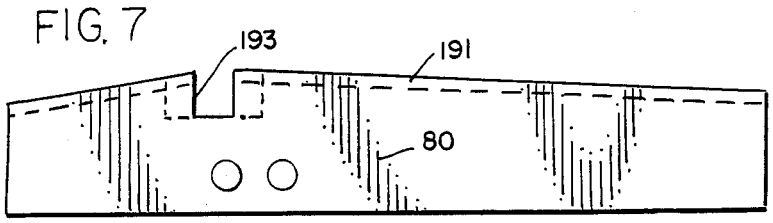
FIG. 7 is a plan view of the knife construction of the mechanism and comprises a cross sectional view taken substantially the line 7—7 in FIG. 5.

The carriage 54 is mounted to reciprocate along one side of the pathway 32. A finger member 60 is attached to a pivot shaft 62 extending from the carriage 54. The finger member 60 thus pivots about the axis defined by the pivot shaft 62. A plow 66 projects laterally from the finger member 60. The finger member 60 is spring biased for movement or otherwise pivoted in the counterclockwise direction as viewed in FIG. 3. This causes the plow 66 to be retracted from the path of the ribbon 18 and more particularly out of position for engagement through opening 40. However, when the carriage 54 is driven in the vertical downward direction from the position as depicted in FIG. 3, the plow 66 is simultaneously driven by a camming mechanism clockwise against any biasing forces on finger 60 and thereby pivoted against the back surface 22 of the ribbon 18 so as to engage opening 40. This causes the ribbon 18 to be advanced an incremental distance in response to direct movement of the carriage 54 vertically downward.

Upon reaching the lower vertical position of travel associated with the carriage 54, the camming mechanism for finger 60 is released causing the plow 66 to retract from opening 40 as the finger member 60 pivots about shaft 62 in the counterclockwise direction. The carriage 54 then moves upwardly in a vertical sense for repositioning member 60 in opposed relationship to the ribbon 18 and for reengagement of the finger member 60 and, more particularly, the plow 66 through an opening 40 and, in particular, the next feeding opening 40 in the ribbon 18. In this manner, the reciprocal movement of the carriage 54 advances the ribbon 18 in incremental amounts by cooperation of the finger 60 with ribbon 18 and more particularly the plow 66 with the opening 40.

Subsequent to each incremental movement of the ribbon 18 in a downward vertical direction in response to the operation of the finger member 60, a knife mechanism operates to sever the ribbon 18 along the imaginary line 34 previously discussed. Thus, referring to the figures, a knife 80 reciprocates in a horizontal plane between a retracted position in opposed relation to the ribbon 18 and a cutting position. The knife 80 thus moves transverse to the ribbon 18. The knife 80 is mounted on a knife carriage 82 also mounted on the frame 44. The knife carriage 82 moves intermittently in response to a drive mechanism that is timed via a mechanical linkage with the movement of carriage 54.

The knife 80 cooperates with an anvil 81 to shear or cut the end of the ribbon 18 after the ribbon 18 is moved downward along pathway 32 to its lower extreme position by means of operation of the carriage 54. Thus, once the carriage 54 reaches its extreme lower vertical position, the knife 80 is operated to cut the end premium unit 33 of the ribbon 18. The cut unit 33 of the ribbon 18 then falls as an individual unit or premium unit 33 vertically downward into a hopper 110 or package 14 as the case may be.

Feed Finger Mechanism

FIGS. 8–14 illustrate in greater detail the construction of the feed finger mechanism. The feed finger 60 is pivotally mounted on shaft 62 attached to a mounting block 63. Mounting block 63 is affixed to carriage 54 which, in turn, is slidably mounted for reciprocal movement on vertical rods 50 and 52. A plow or nose 66 is supported by a pin 67 which fits through the upper portion of the nose 66 and is affixed to the feed finger 60. The plow or nose 66 includes a forward projection 69 which is shaped to fit within the tab opening 40. The nose 69 is spaced vertically downward from the pivot pin 67 so that the nose 69 may traverse an arc and locate itself within the tab opening 40 in the event the tab opening 40 is shifted slightly from the normal alignment of the feed finger 60 with the strip 18 as it passes along the pathway 32. A pin 71 projects from the lower portion of the feed finger 60 and engages within a slot 73 defined in the nose portion 66. The slot 73 is an arcuate slot adjacent the projection 69 and serves to limit pivotal movement of the nose 66 about the pin 67.

Figure 9:
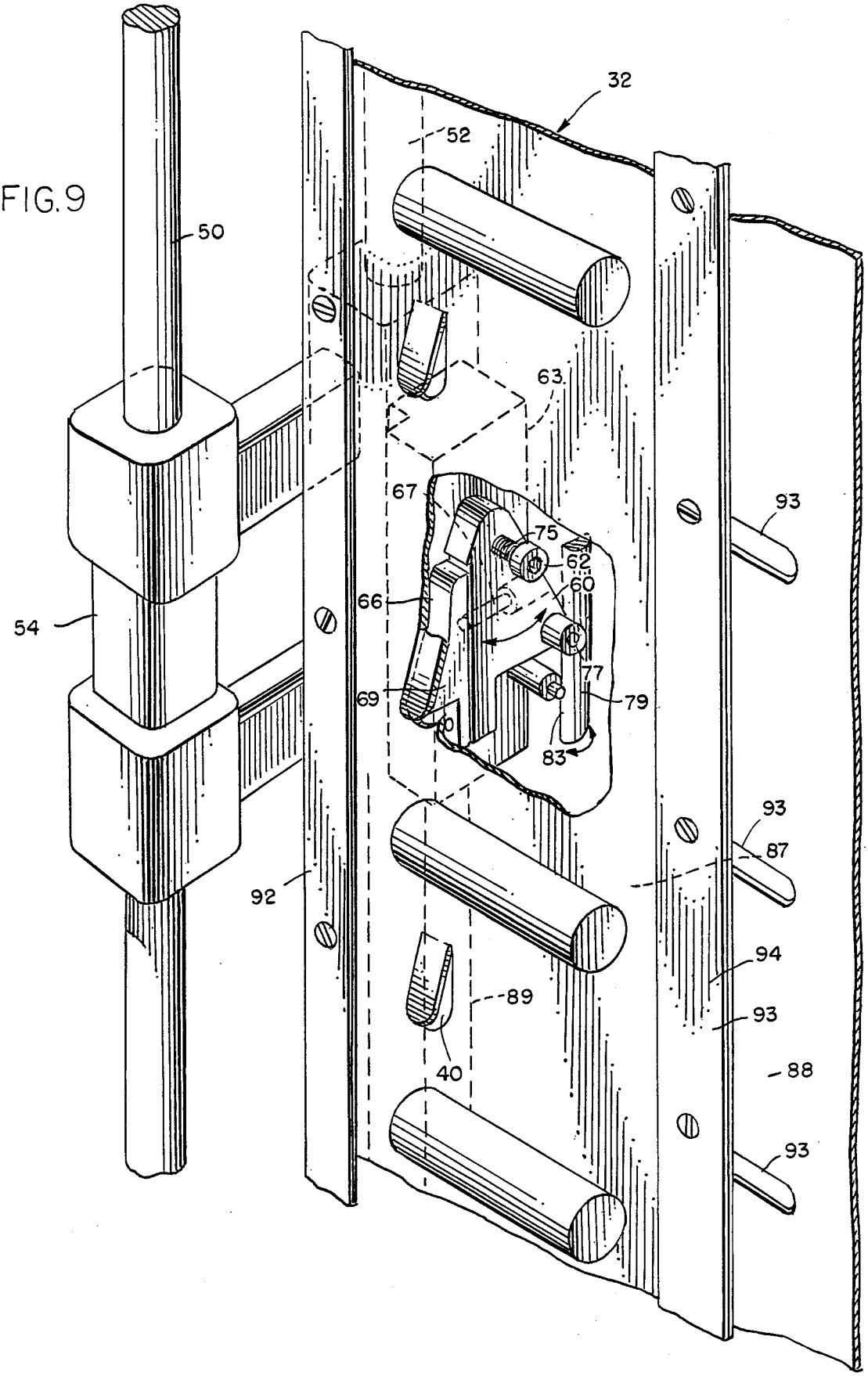
FIG. 9 is an enlarged schematic perspective of the feed finger mechanism illustrating the cooperation of the feed finger with the strip.

A coil spring 75 in FIG. 9 fits about the shaft 62 and engages the finger 60 to bias the finger 60 in a counterclockwise direction as viewed in the figures. Thus, the finger 60 is normally biased so that the nose 66 will be disengaged from the tab opening 40 associated with the strip 18.

Figure 11:
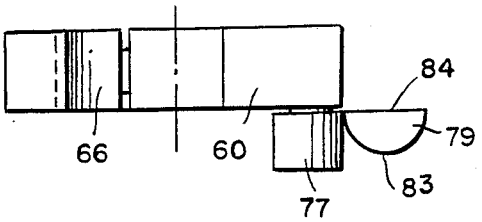
FIG. 11 is a top view of the mechanism depicted in FIG. 10.
Figure 13:
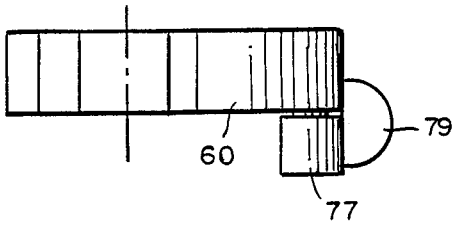
FIG. 13 is a top view of the mechanism depicted in FIG. 12.
Figure 12:
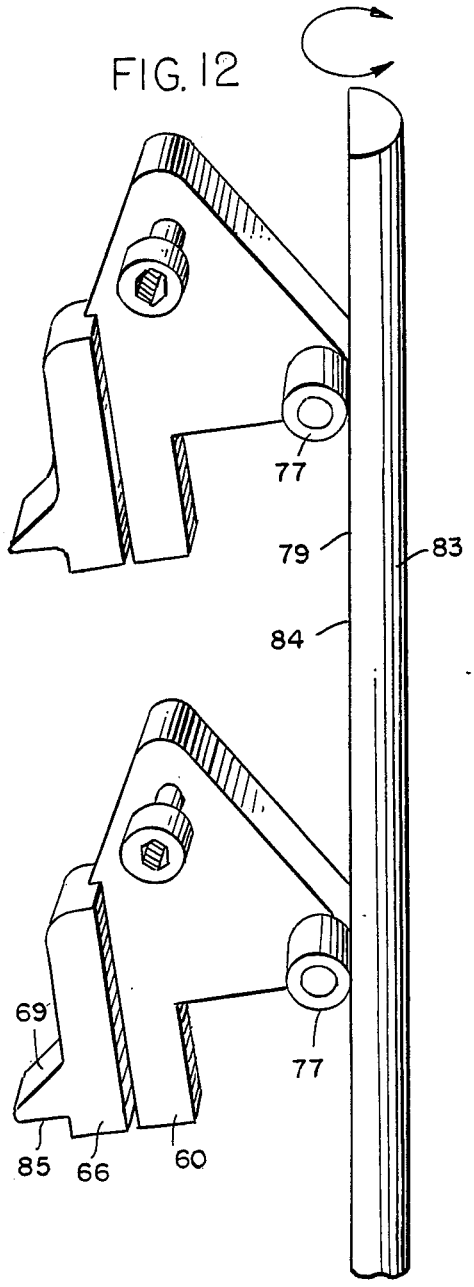
FIG. 12 is a side schematic view of the cam drive mechanism for the feed finger in the retracted position.
Figure 14:
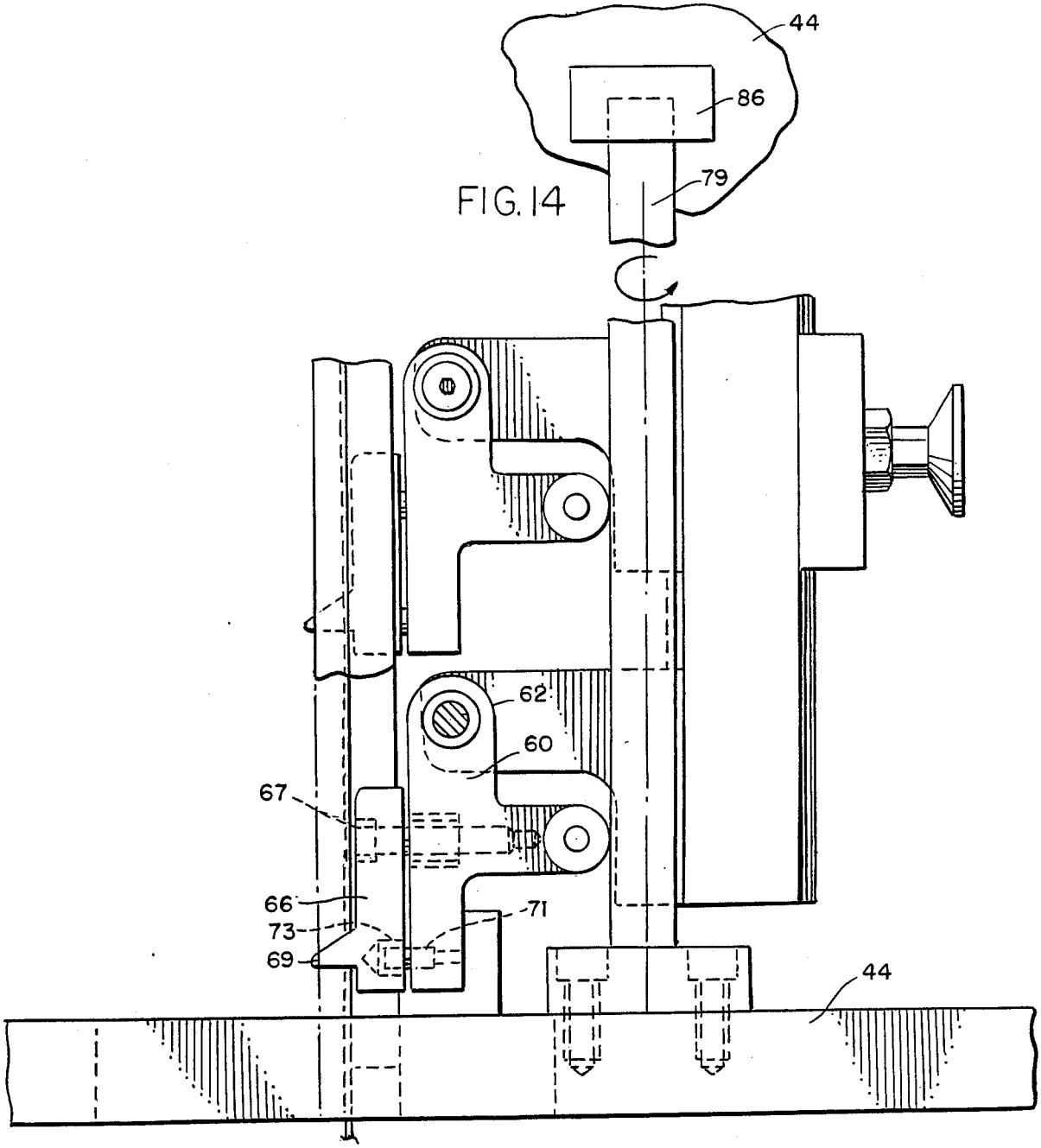
FIG. 14 is a detailed slde view of the feed finger mechanism.

The feed finger 60 includes a cam roller 77 positioned on the back side of the feed finger 60 for cooperation with a pivoting cam rod 79 (FIGS. 11–13). Cam rod 79 is a vertical rod generally parallel to the slide rods 50 and 52. Cam rod 79 is driven pivotally about its vertical axis. Cam rod 79 includes a flat cam actuating surface 84 and an arcuate surface 83. The shaft 79 is pivotal about its vertical axis and is driven by a rotary solenoid 86 affixed to frame 44 (FIG. 14). The rotary solenoid 86 maintains the shaft 79 in the position shown in FIG. 13 whenever the feed finger 60 and carriage 54 retract vertically upward. The solenoid 86 operates to rotate the shaft 79 to the position shown in FIG. 11 whenever the feed finger 60 is to be driven vertically downward on carriage 54. Thus, when the shaft 79 is in the position shown in FIG. 11, the shaft arcuate surface 83 will engage the roller 77 thereby driving the feed finger 60 and, more specifically, the nose 66 into engagement with the back surface 22 of the web or strip 18. The nose projection 69 will then pass through the tab opening 40. The lower surface of the projection 69, namely surface 85, will engage against the strip 18 and upon movement of carriage 54 drive the strip 18 downward for a unitary distance in response to movement of the drive wheel 58 which drives the shaft 56.

Figure 8:
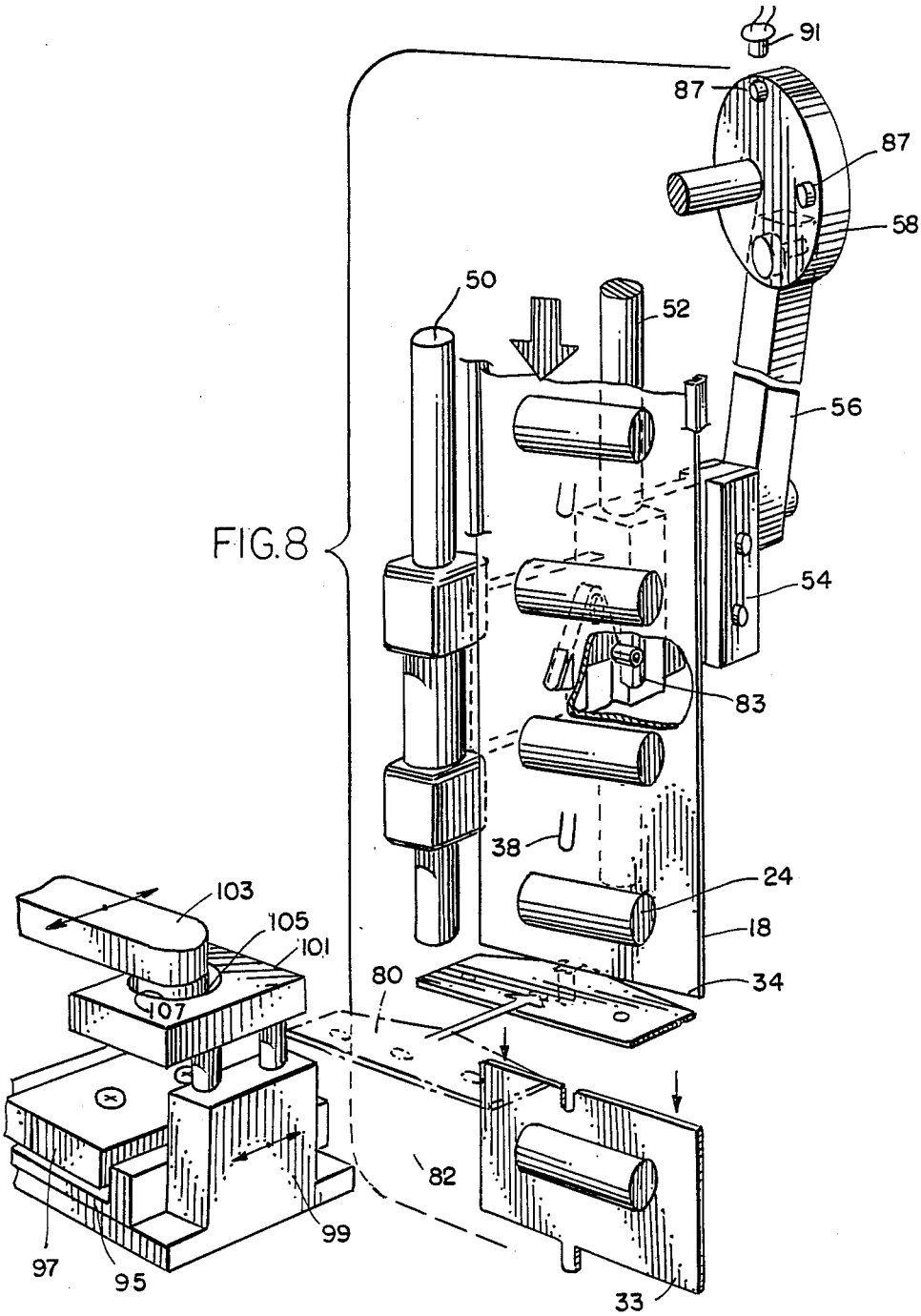
FIG. 8 is a schematic perspective of the combined features of the invention illustrating their means for cooperative engagement.

The reciprocal operation or movement of the feed finger 60 about the shaft 62 is coordinated with the movement of the carriage 54 by the use of proximity sensors 87, 89 which are positioned with respect to periphery of the wheel 58 and sensed by a detector 91 (FIG. 8). During the cycle of the wheel 58, detector 91 will sense proximity sensors 87, 89 and thus indicate the position of the edge of the wheel 58 and the drive shaft 56 attached to carriage 54. When appropriate signals or proximity positions of the wheel 58 are sensed, signals are provided to the rotary solenoid 86 which controls the shaft 79. In this manner the rotary solenoid 86 is cycled to pivot between the positions of FIGS. 11 and 13 to thereby control the operation of the feed finger 60 in a coordinated fashion with the reciprocal movement of the carriage 54.

It is noted that the pathway 32 which receives the strip 18 and provides a straight vertical path for the strip 18 is comprised of a first plate 88 which has a vertical slot 90 so that the projection or nose 66 may fit through the slot 90 and traverse the slot 90 during movement of the carriage 54. A fixed guide rail 92 is provided along the one side of the plate 88 and defines a recess to retain and guide the edge of the strip 18 as that strip 18 traverses along the plate 88. A rail 94 of similar construction is provided on the opposite side of the plate 88. The rail 94 is adjustable in slots 93 in order to accommodate strips 18 of varying widths.

Cut-Off Mechanism

As shown in FIG. 8, the knife 80 moves in a direction transverse to the strip 18 which is to be cut along the line 34. The knife 80 is mounted on a carriage 82 which reciprocates transverse to the strip 18. The knife 80 defines a cutting edge 91 with a gap or slot 93 defined in the blade 80 and positioned in opposed relation to the path of travel of the tab 38. This ensures that when the knife 80 traverses into the path of the strip or ribbon 18, that the tab 38 will not be cut and thus will not form a shard or piece of material which falls separately into the package such as into a cereal package 14.

In any event, the knife carriage 82 is mounted on a slide 95 which cooperates with a stationary block 97 supported on the frame 44. The carriage 82 also includes a bracket 99 which connects with a yoke 101. A reciprocating lever arm 103 engages and drives a roller 105 which fits within a channel 107 on the yoke 101. The lever 103 reciprocates back and forth in the direction depicted by the arrow in FIG. 8 to thereby drive the carriage plate 82 toward and away from the strip 18.

The lever arm 103 is driven through a linkage and power train generally shown at 109 in FIG. 3. This linkage 109 is driven by the same motor which drives the wheel 58 thus ensuring that there is mechanical coordination of the movement of the wheel 58 with respect to the lever 103. Consequently, at the lower end of the stroke of the carriage 54, the knife 82 is driven into engagement with the strip 18 over the anvil 81 to thereby shear the strip 18.

Alternative Constructions

Figure 10:
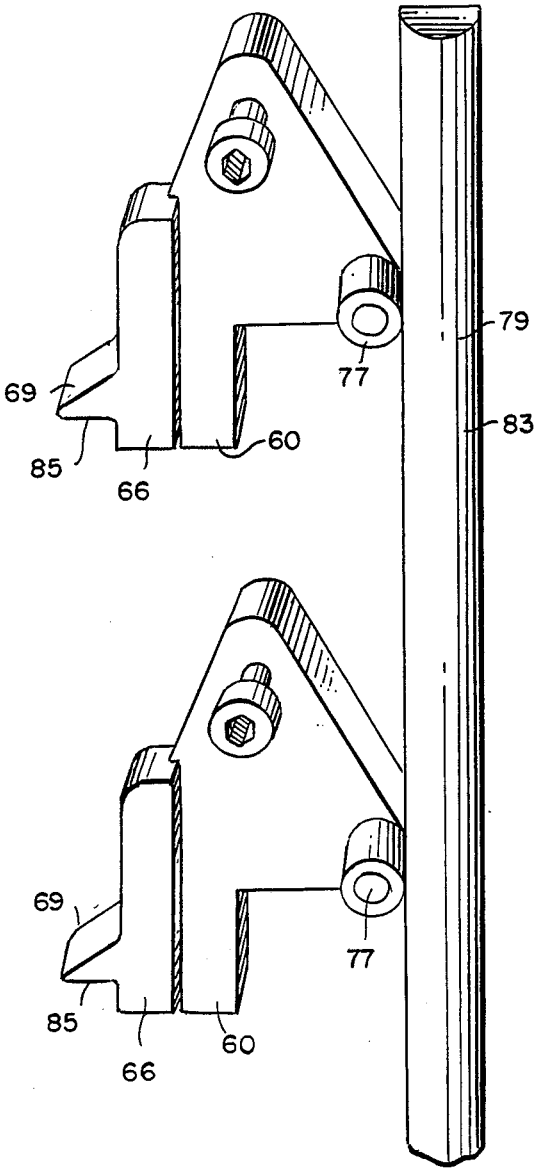
FIG. 10 is a side schematic view of the cam drive mechanism for the feed finger in the projected position.

In practice, a plurality of feed members or fingers 60 such as two feed fingers depicted in FIG. 14 may be incorporated for movement with the carriage 54. This arrangement is preferred to permit simultaneous and dual driving by the feed fingers 60 of the strip 18. In such a circumstance, the use of two fingers 60 permits processing of lighter gauge material for the strip 18. Of course, even though two feed fingers 60 are utilized as depicted in FIG. 14, only a single rotary shaft 79 is required since that shaft may simultaneously drive both the cam rollers 77 of feed fingers 60 as depicted in FIGS. 10 and 12.

The entire mechanism may be used in combination with various other labeling and feed mechanisms. For example, the premium unit 33 of the ribbon 18 may be fitted into a transfer unit such as a hopper 110 for transfer to a package 14. Alternatively, the premium unit 33 may fall directly into a package 14.

Thus, while there has been set forth a preferred ennbodiment of the invention, it is to be understood that the invention is to be limited only by the following claims and their equivalents.

What is claimed is:

1. An improved mechanism for feeding a strip of material and for cutting discrete lengths from said strip, said strip of the type having a front side and a back side said front side including a three dimensional object thereon and projecting therefrom said mechanism comprising, in combination:

a frame;

a strip pathway assembly supported on the frame, said pathway assembly including an arcuate run and a connected, generally straight line discharge run for continuously supporting a strip with the back side facing inward toward the center of the radius of curvature of the arcuate run, said strip having a plurality of precut tabs therethrough with the free end of each tab extending in the direction of strip travel in the runs, the three dimensional object projecting radially outward from the front side and movable with the strip along the pathway;

a feed finger supported on the frame, said feed finger positioned to project from the back side of the strip through an opening defined by said precut tab in the strip, said finger extending from the back side of the strip through the straight line run and against a tab and to thereby engage the strip for transport of the strip in response to movement of the feed finger in the direction of the free end of the tab;

a slide support on the frame positioned on the back side of the strip for mounting the feed finger;

means for driving the slide support reciprocally in the direction of the straight line run;

said feed finger including a plow which is sized to fit through the opening defined by the tab, said feed finger pivotally mounted on the slide support for pivoting about a pivot axis toward the back side of the strip and through the opening and away from the strip out of engagement with the opening; and means for pivoting the feed finger toward the back side of the strip into the opening as the slide support moves in the direction of strip travel and away from the back side of the strip out of the opening as the slide support moves in the opposite direction, said means for pivoting comprising (i) a lever arm extending from the feed finger; and (ii) a cam rod extending in the direction of slide support movement, said cam rod continuously engaging the lever arm of the feed finger, said cam rod rotatable about an axis parallel to the direction of slide support movement to thereby engage and pivot the feed finger lever arm to enable control of pivoting movement of the feed finger through a range of reciprocal movement of the slide support.

2. The mechanism of claim 1 wherein means for cutting the strip is supported on the frame downstream from the feed finger.

3. The mechanism of claim 2 wherein the means for cutting comprises a knife blade and means for reciprocating the knife blade transversely toward and away from the strip.

4. The mechanism of claim 3, wherein the knife blade comprises a knife edge transverse to the strip with a gap in the edge opposed to the tab whereby the tab is uncut by the severing action of the blade.

5. The mechanism of claim 1 wherein the means for pivoting the feed finger comprise biasing means for biasing the feed finger about its pivot axis away from the strip and mechanical cam drive means for pivoting against the force of the biasing means and for maintaining the feed finger in engagement with the strip.

6. The mechanism of claim 1 wherein the plow of the feed finger is pivotally mounted on the feed finger for movement about an axis transverse to the strip whereby the plow accommodates variations in the position of the tab opening in the strip.

7. The mechanism of claim 2 wherein the means for cutting and the means for driving the feed finger are mechanically linked.

* * * * *